US005913517A

United States Patent [19]

Gaffney et al.

[11] Patent Number: 5,913,517

[45] Date of Patent: Jun. 22, 1999

[54] CHESS GAME APPARATUS

[76] Inventors: Eileen Gaffney, 37-G Ridge Rd., Greenbelt, Md. 20770; Frederick Wayne Atzrodt, 13607 Colgate Way—#328, Silver Spring, Md. 20904; Erin Danielle Gaffney, 37-G Ridge Rd., Greenbelt, Md. 20770

[21] Appl. No.: 09/008,777

[22] Filed: Jan. 20, 1998

[51] Int. Cl.[6] ..... A63F 3/02

[52] U.S. Cl. ..... 273/241; 273/260; 273/284; 273/287; 273/309

[58] Field of Search ..... 273/241, 260, 273/261, 283, 284, 287, 288, 309

[56] References Cited

U.S. PATENT DOCUMENTS

| | | | |
|---|---|---|---|
| 3,343,841 | 9/1967 | Arend | 273/284 |
| 5,338,041 | 8/1994 | Jones et al. | 273/260 |

OTHER PUBLICATIONS

Home Mechanix, "Room Board" by Lars Dalsgaard, Nov. 1988, pp. 50–52 and 54.

The Paragon Fall 1991, "Dinosaur Checkers", p. 60, Aug. 1991.

*Primary Examiner*—Benjamin H. Layno

[57] ABSTRACT

A chess board/box housing having a top wall of a chess board pattern with a prehistoric scene superimposed over 64 alternately colored white and dark green playing squares, arranged to selectively receive groupings of specific dinosaur chess pieces. The prehistoric scene includes continents and land masses as they are perceived to have existed (i.e. Jurassic or Triassic period). The underside of the playing board will have a raised and landscaped terrain with mountains, volcanoes, ponds, palm trees, etc., for the use in "imaginary" dinosaur play. The game is housed in a square (14"×14"), 6"–8" deep box, with a ⅛" to ¼" lip to store or house the game pieces when not in use, or for use when playing the Board Game side of Tyrannosaurs Chess. Conversely, the same "housing" apparatus may be used, if desired, to keep in place the terrain/landscaped inverted board.

3 Claims, 4 Drawing Sheets

FIGURE 1C (INVERTED)

29
Board w/represented dinosaur figures (Fig. 2G)

Tyrannosaurs Chexx
1 - Tyrannosaurs Rex (Fig. 2A)
1 - Corythosaurus (Fig. 2B)
2 - Triceratops (Fig. 2C)
2 - Velociraptor/Pterodactyl (Fig. 2D)
2 - Pachycephalosaurus (Pakee) (Fig. 2E)
8 - Ankylosaurus (Fig. 2F)
Traditional Chess
King
Queen
Bishops
Knights
Rooks
Pawns

CHESS GAME APPARATUS

CROSS REFERENCE TO RELATED APPLICATIONS

U.S. Pat. No. 4,856,789 August 1989 Carlson . . . 273/261

U.S. Pat. No. 5,257,787 November 1993 Miccio . . . 273/260

U.S. Pat. No. 5,306,017 April 1994 Huston . . . 273/261

U.S. Pat. No. 5,338,041 Aug. 16, 1994 Jones, et al.

STATEMENT RE: FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The field of the invention relates to a chess game apparatus, and more specifically pertains to a new and improved dinosaur chess game apparatus wherein the same is arranged to include the designation of various dinosaur playing pieces.

2. Description of the Prior Art

Chess games structures of varying types are indicated in the prior art and are exemplified by the U.S. Pat. Nos. 4,856,789; 5,257,787; 5,306,017; and 5,338,041.

The instant invention attempts to overcome deficiencies of the prior art by providing a different and enhanced entertainment medium by employing chess components representative of the ever-popular dinosaur "culture" and time period. Further, the instant invention attempts to attract and retain the interest of a younger player through incorporation of dinosaur figures and the design and development of the three-dimensional and dual purpose playing board.

BRIEF SUMMARY OF THE INVENTION

In consideration of the foregoing disadvantages inherent in the known types of chess game apparatus now available in the prior art, the present invention provides a dinosaur chess game apparatus including a plurality of designated players arranged for positioning and storage within a three-dimensional housing representative of a prehistoric time period. As such, the general purpose of the present invention, which will be described subsequently in greater detail, is to provide a new and improved dinosaur chess game apparatus that has all the advantages of the prior art chess game apparatus and none of the disadvantages.

To accomplish this, the present invention provides a housing having a top plane/wall of a chess board pattern, with a prehistoric scene superimposed, arranged to selectively receive groupings of specifically designated dinosaur chess pieces (FIGS. 2A–2G). The bottom/underside of the playing board has a raised and landscaped terrain (i.e. mountains, volcanoes, ponds, palm trees) for the player use in "imaginary" dinosaur play. The game and playing pieces are stored in the aforementioned housing apparatus (14"× 14" square, 6" to 8" deep box, with a ⅛" to ¼" interior lip).

Our invention resides not in any one of these features per se, but rather in the unique combination of all of them herein disclosed and claimed, and it is distinguishable from the prior art in this particular combination of all its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the appended abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dinosaur chess game apparatus which has all the advantages of the prior art chess game and none of the disadvantages.

It is another objective of the present invention to provide a new and improved dinosaur chess game apparatus which is of a durable and reliable construction.

An additional objective of the present invention is to provide a new and improved dinosaur chess game apparatus which is susceptible of a low cost of manufacture with respect to both materials and labor, and which is accordingly susceptible of low prices of sale to the consuming public, thereby making such dinosaur chess game apparatus economically accessible to the buying public.

Another object of the present invention is to provide a new and improved dinosaur chess game apparatus which provides in the apparatuses and methods of the prior art some of the advantage thereof, while concurrently overcoming some of the disadvantages normally associated herewith.

These together with other objects of the invention, along with the various features of novelty which characterize the invention, are pointed out with particularity in the claims attached to and forming a part of this disclosure. For a better understanding of the invention, its operating advantages and the specific object attained by its uses, reference should be made to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the attached drawings wherein:

FIG. 2G is an illustration of the category of player tokens in their respective playing positions.

DETAILED DESCRIPTION OF THE INVENTION (PREFERRED EMBODIMENT)

Figure 1A:
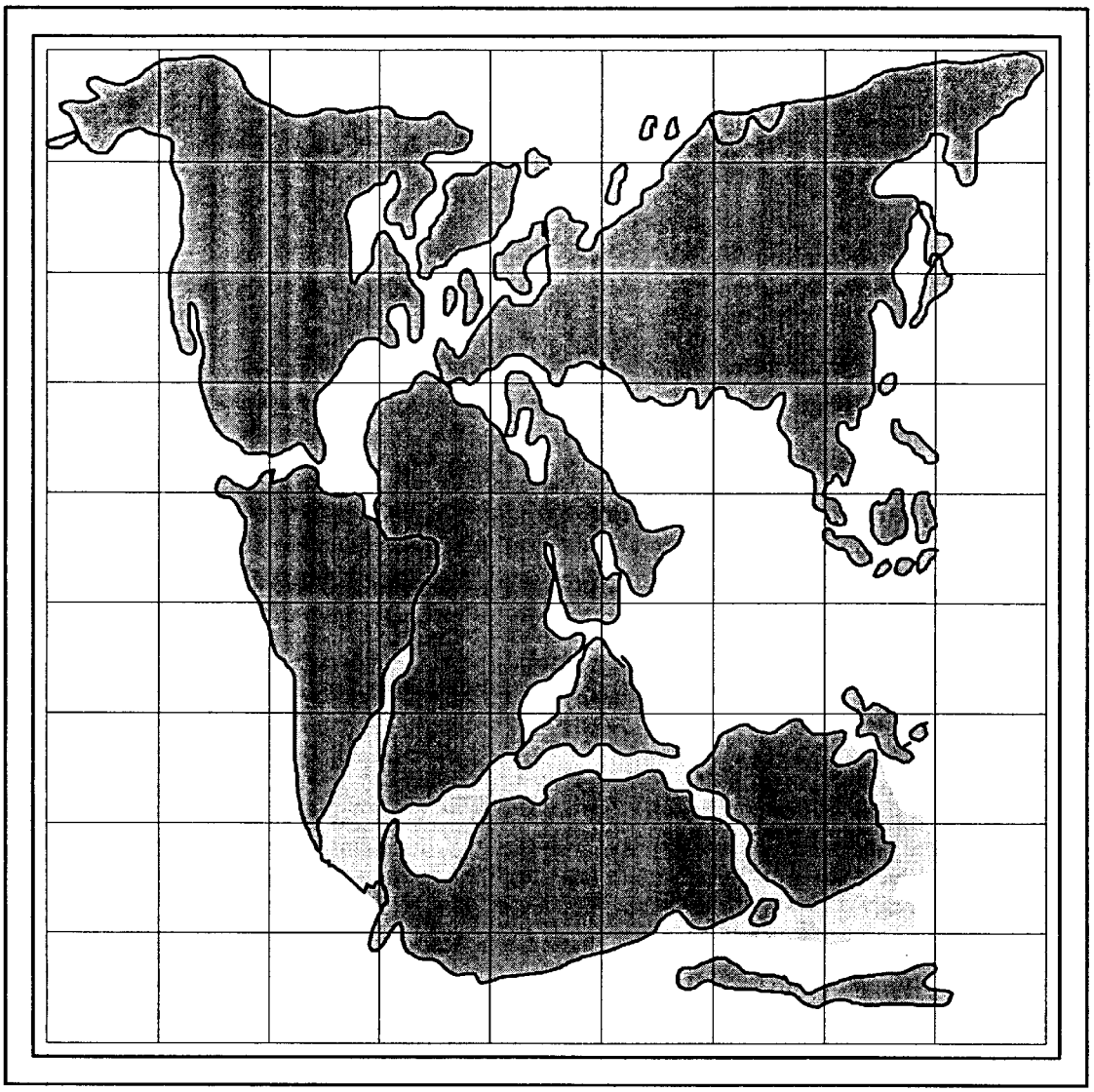
FIG. 1A is an isometric illustration of the chess game board, comprised of eight vertical and eight horizontal rows with a prehistoric scene superimposed over 64 alternately white and dark green playing squares.
Figure 1B:
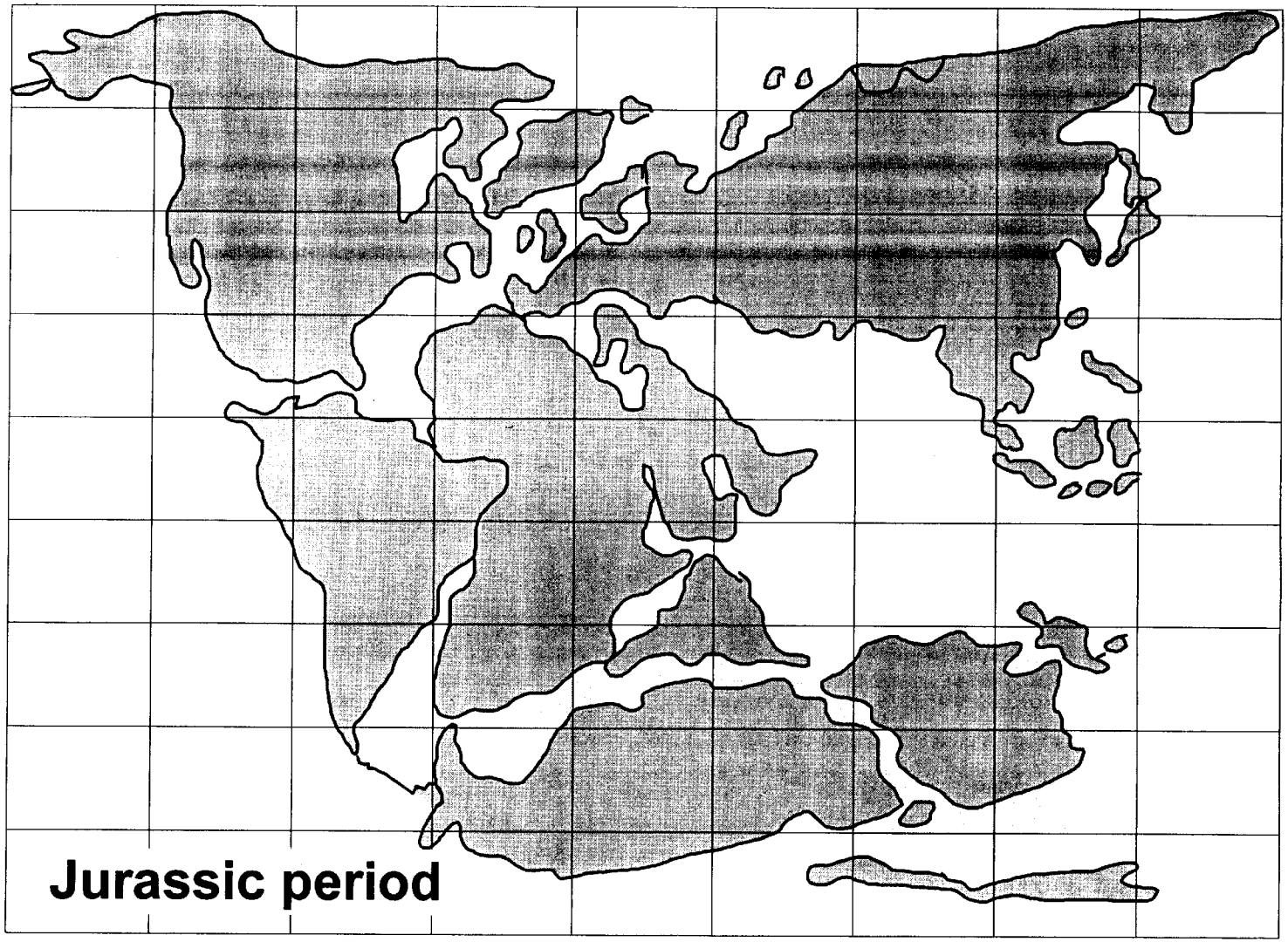
FIG. 1B is an isometric enlarged view of the board with the aforementioned prehistoric scene which further details continents and land masses as they are perceived to have existed (i.e. Jurassic or Triassic period).

With reference now to the drawings, and in particular to FIGS. 1A through 2G thereof, a new and improved dinosaur chess game apparatus embodying the principles and concepts of the present invention and generally designated by the reference numeral 20 will be described.

More specifically, the dinosaur chess game approaches (20) of the instant invention essentially comprises a housing (21) having spaced side walls (22), as well as spaced front and rear walls (23), and a top wall (24), having a chess board pattern (25) of a type as indicated in conventional prior art such as indicated in U.S. Pat. No. 4,300,768 relative to the chess board pattern alone. The FIGS 2A through 2F (26) indicate player tokens of sufficient number and contrasting colorations to indicate plural sets of opposing players for use in conventional chess game, with such movement of players controlled by conventional chess rules. The number of individual players relative to use of play of a chess game is known in the prior art and details to such numbering and their various players such as to provide for representation and operative association to the chess player tokens of the "king, queen, bishops, knights, castle, pawns", and the like are per se known in the prior art.

Figure 1C:
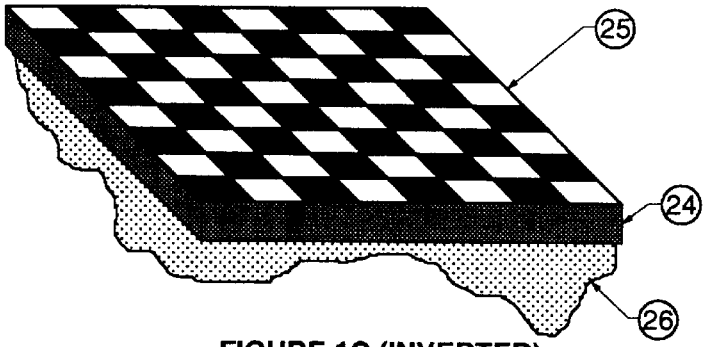
FIG. 1C represents a lateral view of the inverted or underside of the playing board. This view illustrates the raised and landscaped terrain (i.e. mountains, volcanoes, ponds, palm trees, etc).
Figure 1C:
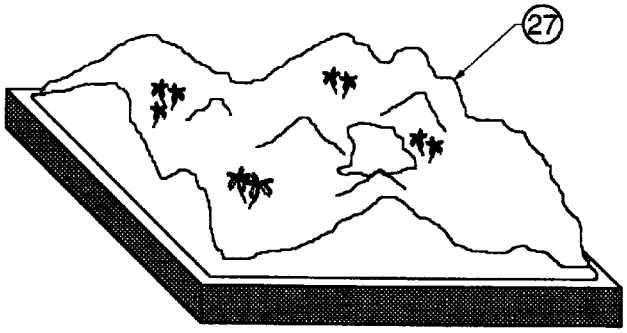
Figure 1D:
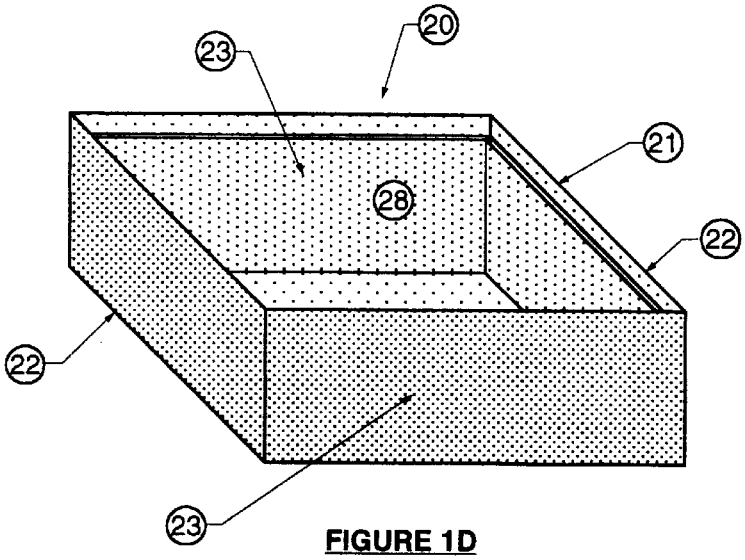
FIG. 1D is an illustration of the game apparatus and associated housing structure. The game is housed in a square 14"×14", 6 to 8" deep box with a ⅛" to ¼" interior lip.
Figures 2A, 2B, 2C, 2D, 2E, 2F:
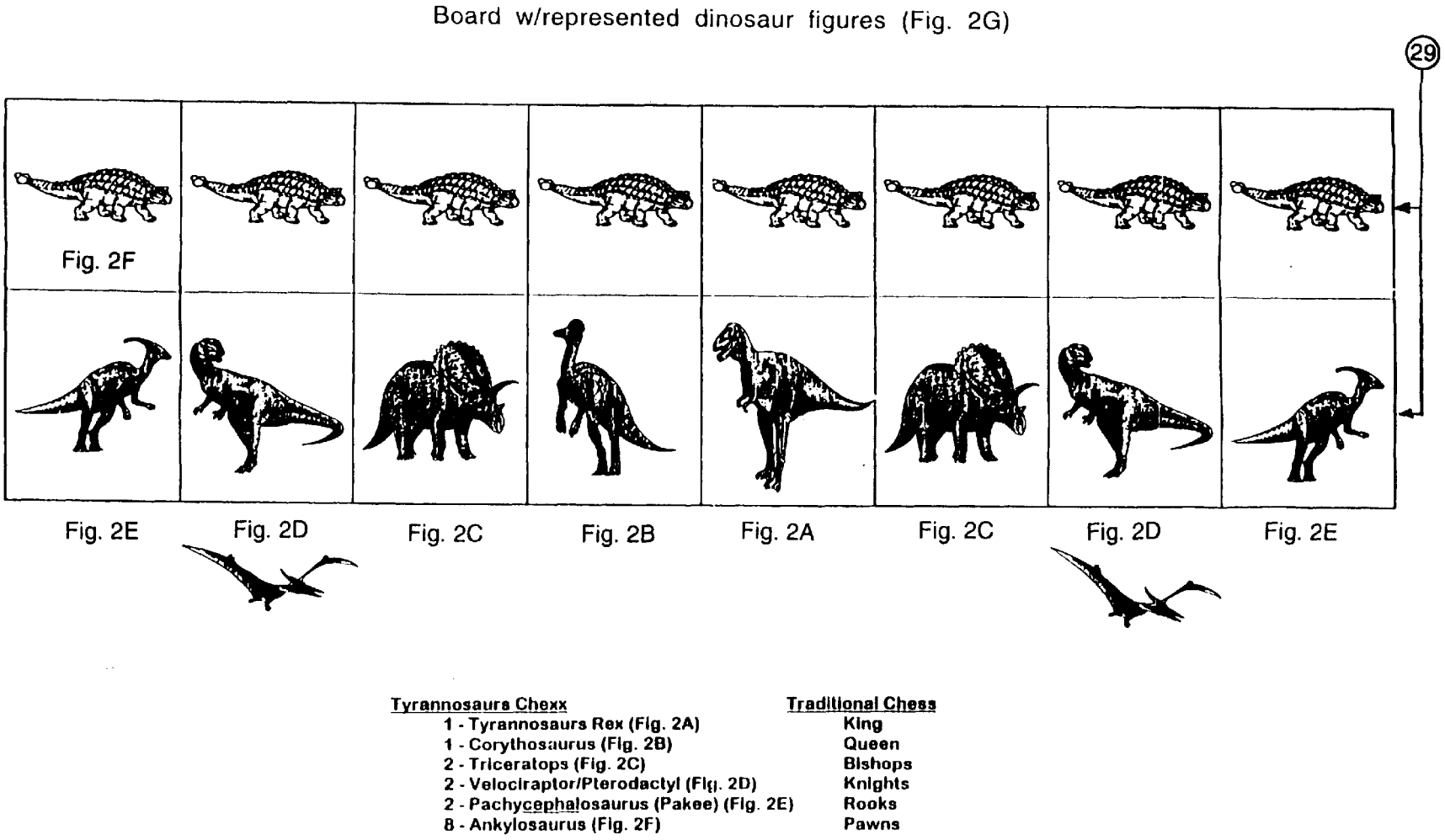
FIGS. 2A through 2F are a representative indication of the category of dinosaur player tokens.

The FIG. 1C represents the inverted or underside top wall (26) having a raised and landscaped prehistoric terrain (27). It is anticipated that the landscaped terrain may used for use in "imaginary" dinosaur play. The interior (28) of the housing apparatus (20) is designed for storage and receipt of the playing pieces (29), as well as storage of the inverted board (27).

The dinosaur player token representations (29) were specifically designated or chosen for the replication of the movements inherent in traditional chess game play (i.e. Tyrannosaurs Rex=King, Corythosaurus=Queen, Triceratops=Bishop, Velociraptor/Pterodactyl=Knight, Pachycephalosaurus=Rock, and Ankylosaurus=Pawns).

As to the manner of usage and operation of the instant invention, the same should be apparent from the above disclosure, and accordingly no further discussion relative to the manner of usage and operation of the invention shall be provided.

With regard to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only by the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim as being new and desired to be protected by Letters Patent of the United States in the following:

1. A dinosaur chess game apparatus, comprising a housing having spaced side, rear and front walls, a removable top wall representing a playing board having an upright side with a flat surface having a chess board pattern positioned thereon, the playing board also having an inverted side with a raised three-dimensional surface representing a landscaped prehistoric terrain positioned thereon, the side, rear and front walls arranged for supporting the removable top wall with either the upright side or inverted side face up in a horizontal position on top of said housing and a plurality of specific dinosaur player tokens of sufficient number and contrasting colorations to indicate plural sets of opposing players.

2. An apparatus as set forth in claim 1 wherein the side, rear, front and top walls of the housing is arranged for receipt and storage of the player tokens.

3. An apparatus as set forth in claim 2 which includes a prehistoric scene of land masses superimposed over the chess board pattern.

* * * * *